US005433497A

United States Patent [19]

Koenig

[11] Patent Number: 5,433,497

[45] Date of Patent: Jul. 18, 1995

[54] DOOR LATCH WITH PRIVACY FEATURE

[75] Inventor: David D. Koenig, Anaheim, Calif.

[73] Assignee: Masco Building Products Corporation, Taylor, Mich.

[21] Appl. No.: 3,360

[22] Filed: Jan. 12, 1993

[51] Int. Cl.[6] ..... E05B 13/00

[52] U.S. Cl. ..... 292/359; 292/169.14

[58] Field of Search ..... 292/359, 336.3, DIG. 61, 292/169.14, 169.18

[56] References Cited

U.S. PATENT DOCUMENTS

| | | | |
|---|---|---|---|
| 807,808 | 12/1905 | Call . | |
| 2,264,420 | 12/1941 | Voight | 292/359 |
| 2,295,435 | 9/1942 | Teich . | |
| 2,400,403 | 5/1946 | Falk . | |
| 2,499,948 | 3/1950 | Egor . | |
| 2,723,874 | 11/1955 | Hillgren . | |
| 2,796,272 | 6/1957 | Quinn . | |
| 4,055,361 | 10/1977 | Moses . | |
| 4,821,540 | 4/1989 | Hustin . | |
| 4,861,084 | 8/1989 | Ozagir et al. . | |
| 5,083,823 | 1/1992 | Fann et al. . | |

FOREIGN PATENT DOCUMENTS

| | | | |
|---|---|---|---|
| 597382 | 1/1948 | United Kingdom | 292/336.3 |
| 661730 | 11/1951 | United Kingdom | 292/359 |
| 1534879 | 12/1978 | United Kingdom | 292/336.3 |

*Primary Examiner*—Rodney M. Lindsey

*Attorney, Agent, or Firm*—Myron B. Kapustij; Malcolm L. Sutherland

[57] ABSTRACT

A door latch assembly including a privacy mechanism for locking and unlocking the door from the inside comprising a latch casing mounted within a bore in a door; a latch bolt retractably mounted in the casing; a handle spindle extending transversely through the housing and rotatably in said casing; a connecting mechanism engaged with the latch bolt and with the spindle whereby the latch bolt is retracted into the housing upon rotation of the spindle; an escutcheon and handle mounted on the inside of the door, one end of the spindle being non-rotatably mounted in the outside handle; and an escutcheon and handle mounted on the outside of the door, the other end of the spindle being non-rotatably mounted in the inside handle. The privacy mechanism is mounted on the inside handle and comprises a locking plate mounted on the handle interiorly of the escutcheon and rotatable with the handle. The plate has a notch therein which is adapted to be engaged by a push button type locking shaft, mounted on the inside escutcheon, to lock the plate against rotation.

25 Claims, 3 Drawing Sheets

DOOR LATCH WITH PRIVACY FEATURE

FIELD OF THE INVENTION

This invention relates to a latch assembly for doors. More particularly it relates to a latch assembly incorporating a privacy feature.

BACKGROUND OF THE INVENTION

The door lock to which the present invention pertains is incorporated in the usual inside door and includes latch assembly having door knobs or handles projecting from opposite sides of the door and the latching mechanism incorporated within the door between its faces. The present lock construction enables the door to be locked from inside the room by manipulation of a push-pull type locking button on that side to prevent opening of the door by rotation of the knob or handle outside the room. In the present invention the privacy lock structure is mounted directly on the inside handle. The door lock also has an extra release feature. Such a lock may be used on a bathroom or bedroom where the occupant desires privacy but which can be opened from outside the room in an emergency.

SUMMARY OF THE INVENTION

The instant invention provides a door lock incorporating a privacy mechanism wherein the privacy mechanism is mounted on the inside handle of the door, i.e, the handle disposed on the face of the door inside the room.

The latch bolt assembly of the instant invention comprises a latch bolt casing including a reciprocating latch bolt mounted in a bore in the door. The latch bolt is connected to a latch bolt retracting mechanism which acts upon the latch bolt to retract the bolt into the latch bolt casing. The latch bolt retracting mechanism is activated by a handle spindle which is engaged with the retracting mechanism. The handle spindle has two ends, one end non-rotatably connected to an inside door handle and the other end non-rotatably connected to the outside door handle on the opposite side of the door. The inside door handle is mounted to an inside escutcheon and the outside door handle is mounted to an outside escutcheon. A spring-loaded locking plate having a lock notch is non-rotatably mounted on the inside handle whereby rotation of the inside handle will also rotate the locking plate and the handle spindle. A push button type locking shaft is mounted in the inside escutcheon. The push button locking shaft includes a stop cap mounted on the shaft and adapted to engage the lock notch. When the push button locking shaft is pushed in the stop cap engages the lock notch in the locking plate. This prevents the locking plate from rotating. Since the locking plate cannot rotate, the handles and the handle spindle also cannot rotate. Since the handle spindle cannot rotate the latch bolt cannot be retracted into the latch casing and the door cannot be opened. To deactivate the privacy feature the push button locking shaft is pulled out, thereby disengaging the stop cap from the lock notch and allowing rotation of the locking plate, the handles, and the handle spindle.

DETAILED DESCRIPTION OF THE PREFERRED EMBODIMENT

Figure 1:
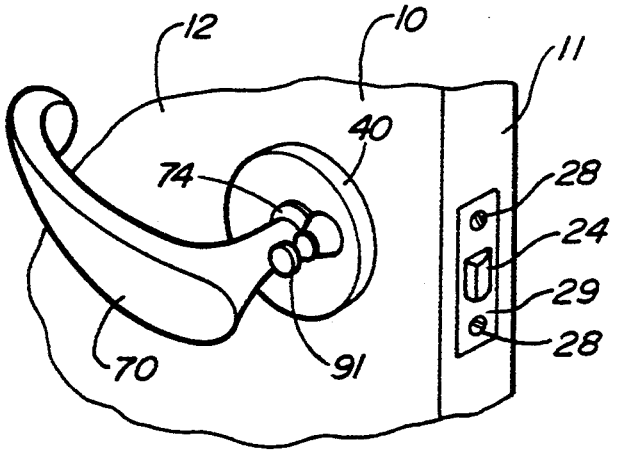
FIG. 1 is a perspective view of a fragment of the interior side or face of a door with the interior or inside handle and control or inside escutcheon mounted in the door.

In FIG. 1 the privacy lock of the instant invention is illustrated mounted on door 10. FIG. 1 illustrates the interior or inside handle 70 and interior or inside escutcheon 40 on the interior or inside face or side 12 of the door 10.

Figure 2:
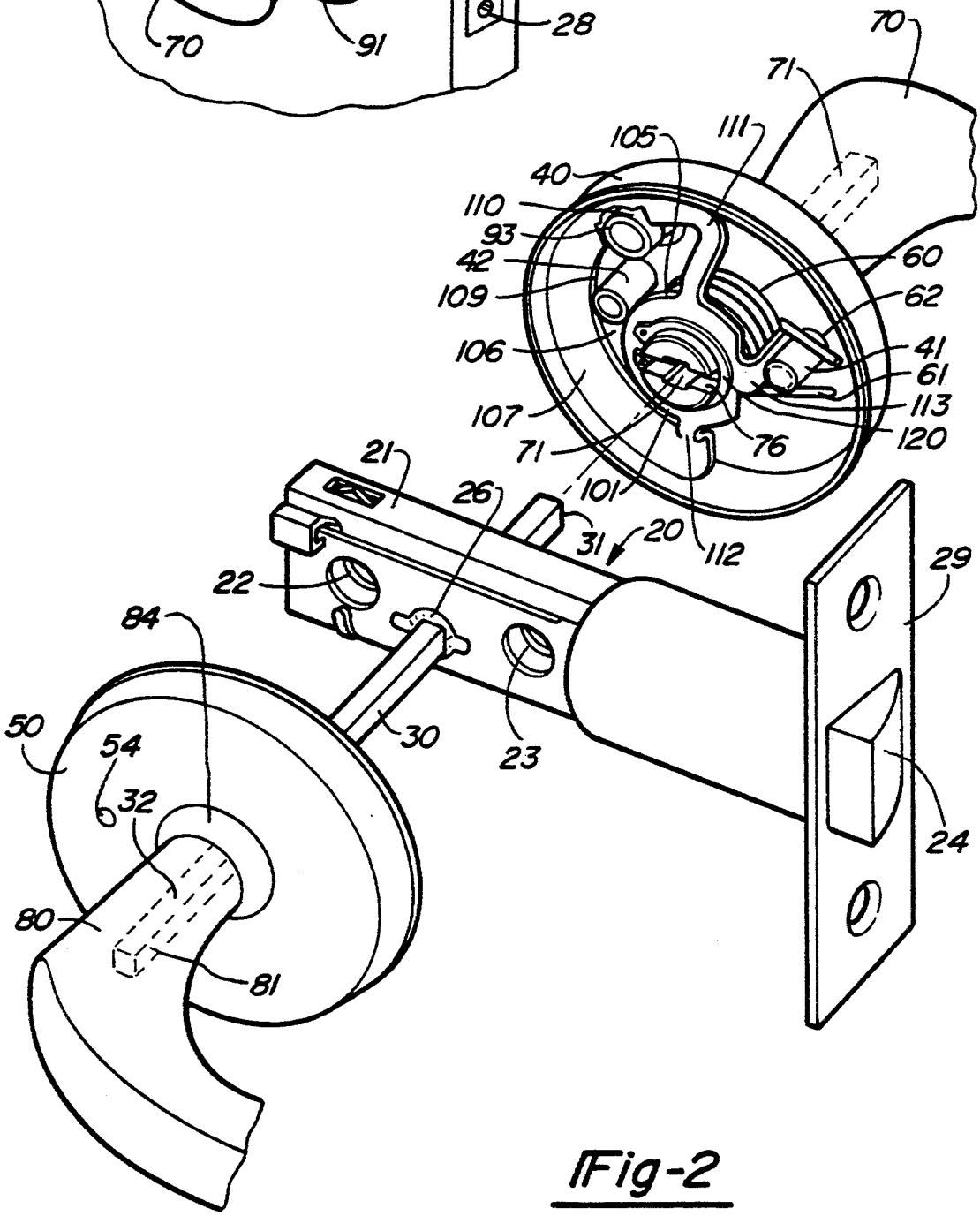
FIG. 2 is a perspective view of the inside handle and escutcheon, outside handle and escutcheon, handle spindle, and latch bolt assembly, with the privacy lock feature in a locked or closed position.

As best illustrated in FIG. 2 the privacy lock comprises a latch bolt assembly 20 which includes a latch casing 21 which is mounted in a bore (not shown) in the door 10, a latch bolt 24 reciprocably mounted in the casing 21, control and connecting mechanism 26 (not shown) arranged within the casing for retracting and extending the latch bolt 24, face plate 29 secured to the swinging edge 11 of the door 10 by screws 28, a spindle 30 engaging connecting mechanism 26, an interior or inside control handle 70, an interior escutcheon 40, an exterior or outside handle 80, and an exterior or outside escutcheon 50. The exterior handle 80 and exterior escutcheon 50 are mounted on the outside face of the door 10.

The latch bolt assembly 20, including the casing 21, latch bolt 24, and control and connecting mechanism 26 for retracting and extending the latch bolt 24 are all of conventional and well known construction. As illustrated in FIG. 2 the spindle 30 engages the latch bolt 24 by any suitable conventional means arranged within the casing 21 such as control and connecting mechanism 26 so that rotation of the spindle 30 will retract the latch bolt 24 through actuation of the control and connecting mechanism 26. In the embodiment illustrated in the Figures the spindle 30 is of a generally polygonal, preferably square, cross sectional shape. The spindle 30 has two end sections 31 and 32. End section 31 is non-rotatably disposed in a complimentary shaped bore 71 in interior of control handle 70. End section 32 is non-rotatably disposed in a complimentary shaped bore 81 in exterior handle 80. Thus, turning either of the handles 70 or 80 rotates the spindle 30 and retracts the latch bolt 24 through the connecting mechanism 26.

The interior or inside escutcheon 40 has two openings 43 and 44 therethrough. Opening 43 is adapted to receive the shank portion 72 of handle 70. Opening 44 receives the stop member 90. Tie rods 41 and 42 are provided in the inner surface of escutcheon 40 to secure the escutcheon 40 to the door. More, particularly screws (not shown) extend through tie rods 41 and 42 into tie rods 51 and 52 of escutcheon 50 to connect escutcheons 40 and 50 together. The tie rods can extend through openings 23 and 22 in latch casing 21.

The shank portion 72 of the handle 70 extends through opening 40 into the interior or inner side of the escutcheon 40. A sleeve 76 having a raised, radially extending annular base 78 fits over the shank portion 72. A spring 60 is seated on the sleeve 76.

A locking plate 100 is mounted on the shank 72 of handle 70. Locking plate 100 has a central disc shaped portion 101 with aperture 102 extending therethrough. Aperture 102 is generally complimentary in cross-sectional shape to the shank 72, e.g., is generally circular, and fits over shank 72. Two tabs 103 and 104 extend radially inwardly into the central aperture 102. The tabs 103 and 104 fit into slot 76 in shank 72, thereby preventing the locking plate 100 from turning on the shank 72.

Figure 3:
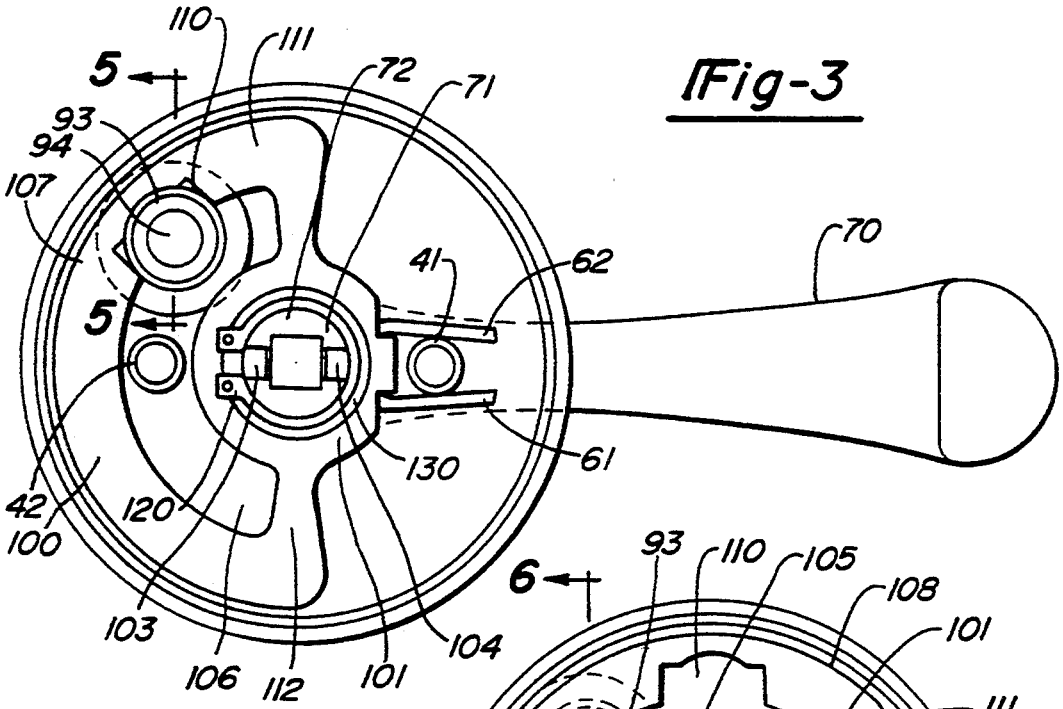
FIG. 3 is a bottom plan view of the inner side of the inside handle and escutcheon with the privacy lock feature mechanism in a locked or closed position.
Figure 4:
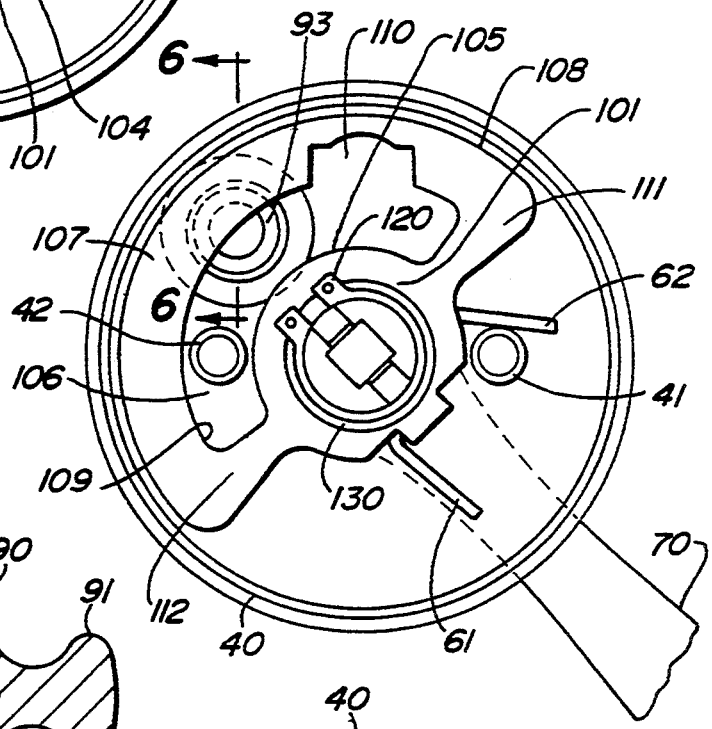
FIG. 4 is a view similar to FIG. 3 but with the handle and locking plate in a different position and the privacy lock feature mechanism in an unlocked or open position.

A generally arcuate shaped radially outer portion 107 of plate 100 is separated from the central portion 101 by a generally arcuate shaped slot 106. The arcuate slot 106 is defined by radially outer edge 105 of central portion 101, and the radially inner edge 109 of outer portion 107, and the two arms 111 and 112. The outer portion 107 is generally semicircular in shape. The two arms 111 and 112 are circumferentially spaced apart on central disk portion by about 180°. As illustrated in FIGS. 3 and 4 slot 106 is sized so that tie rod 42 fits therein and does not interfere with the rotation of plate 100. A radially extending lock notch 110 is provided in the radially outer portion 107, more particularly in the radially inner edge 109 of portion 107. The notch 110 is adapted to receive the stop cap 93 of stop or locking member 90. Stop or locking cap 93 is carried by the stop or locking spindle 92 which is arranged parallel with the axis of the handle spindle 30 and shank 72.

The stop spindle 92 has a control knob 91 at the one end thereof. The control knob 91 is disposed exteriorly of the escutcheon 40 and is used to push the stop cap 93 of stop or locking member 90 into engagement with lock slot 110 in radially outer portion 107 of plate 100, as illustrated in FIGS. 3 and 5, or to pull the cap 93 out of engagement with the lock slot 110, as illustrated in FIGS. 4 and 6.

Figure 5:
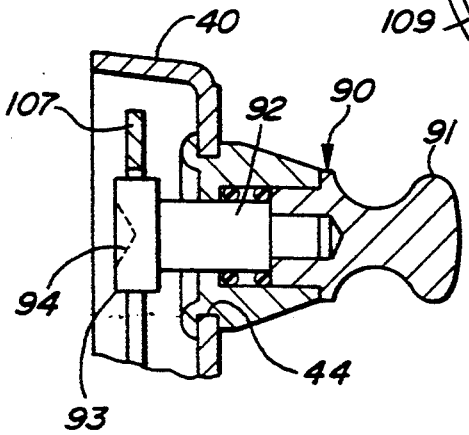
FIG. 5 is a side elevational view in section taken along line 5—5 in FIG. 3.
Figure 6:
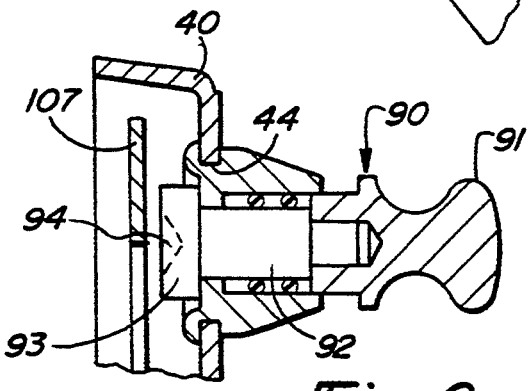
FIG. 6 is a side elevational view in section taken along line 6—6 in FIG. 4.

As best illustrated in FIGS. 5 and 6 locking member 91, 93 is held in against the spring by the shank portion of the central knob 91 being sized so as to form a friction or interference fit with the aperture of the button.

Figure 7:
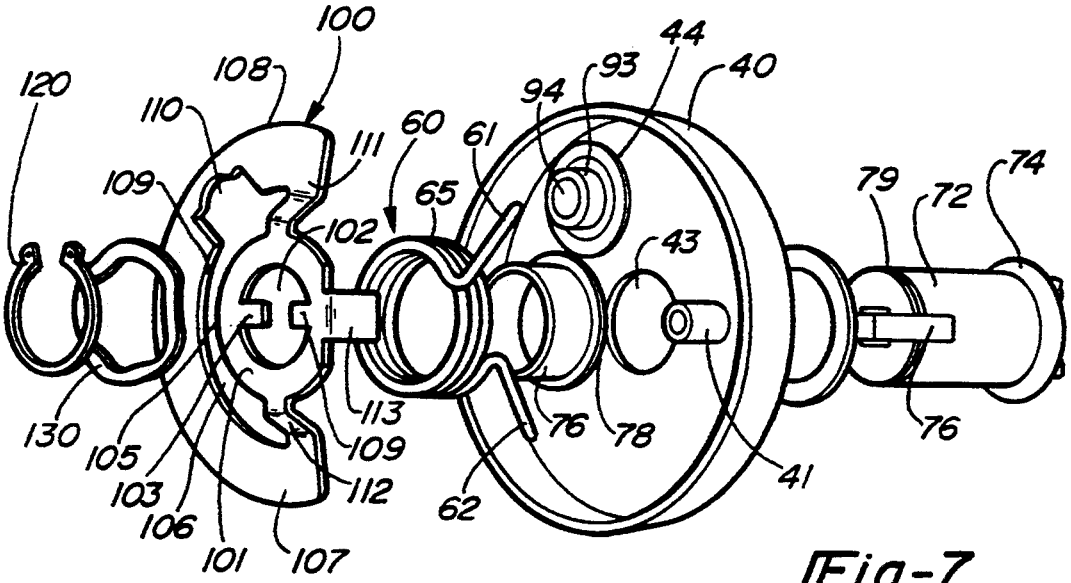
FIG. 7 is a perspective view of the shank portion of the inside handle, the inside or control escutcheon and associated parts.

As best illustrated in FIGS. 2 and 7 the central portion 101 of plate 100 lies in a different plane than the radially outer portion 107. The radially outer portion 107 is closer to the inner surface of escutcheon 40 than the central portion 101. The radially outer portion 107 and the central portion 101 are connected by two generally axially extending arms 111 and 112.

The locking plate 100 is secured to shank 72 of handle 70 against axial movement by snap ring 120 inserted into snap ring annular groove 79 on shank 72. A washer 130 can be disposed intermediate snap ring 120 and the central portion 101 of locking plate 100.

In the "open" or unlocked position of the privacy lock, as illustrated in FIGS. 4 and 6, the stop member 90 is pulled out by pulling on the control knob 91 and, as shown in FIG. 6, the stop cap 93 is below the plane of radially outer portion 107 of plate 100 and out of register with lock notch 110. In the "open" position the stop cap 93 lies between the interior surface of the escutcheon 40 and the radially outer portion 107 of plate 100. With the stop cap 93 out of engagement with lock notch 110 the plate 100, handle 70, handle spindle 30, and handle 80 are able to rotate.

In the "closed" or locked position, as illustrated in FIGS. 2, 3 and 5, the stop member is pushed in by pushing in control knob 91 and, as shown in FIG. 5, the stop cap 93 is received in lock notch 110. This results in the locking plate 100 being held from rotational movement. Since locking plate 100 cannot turn, the handle 70, handle spindle 30, and handle 80 also cannot be turned. Thus, the latch bolt 24 cannot be withdrawn into the casing 21 and the door is locked. Upon pulling on the control knob 91, the stop cap 93 is moved into the position shown in FIG. 6, thus disengaging the stop cap 93 from the lock notch 110 to release the locking plate 100 and the handles for rotational movement.

A helical torsion spring 60 having a plurality of helical coils 65 with a central passage extending through the spring 60, and further having two radially outwardly projecting ends 61 and 62 is disposed over the sleeve 76 intermediate the locking plate 100 and the inner side of escutcheon 40. The ends 61 and 62 are disposed on opposite ends of the spring 60 and are each an integral extension of the coils 65 of the spring and are formed simply by bending the end portions of the spring perpendicularly outwardly. One of ends 61 or 62 abuts against one of tie rods 41 or 42 while the other end abuts against axially projecting tab 114 of locking plate 100. Ends 61 and 62 are angled toward each other. End 61 is angled downwardly (to the right in FIG. 7) while end 62 is angled upwardly (to the left in FIG. 7). This construction insures that the ends 61 and 62 will be engaged by tab 113 and will not slip off the bottom of tab 113.

As illustrated in FIG. 4 if the handle 70 is rotated clockwise (in FIG. 4), end 62 abuts against tie rod 42 while end 61 abuts against tab 113. In the position shown in FIG. 4 the locking plate 100 and, therefore, the handle are biased by spring 60 in a counterclockwise direction to the neutral or original position illustrated in FIG. 3. If the handle is rotated counterclockwise (in FIG. 4) past the neutral position of FIG. 3 end 61 will abut tie rod 41 and end 62 will abut tab 113. The locking plate 100 and handle 70 will then be biased in a clockwise direction (in FIG. 2) to the neutral or original position illustrated in FIG. 1.

The rotational movement of the locking plate 100 and handle 70 is limited by tie rods 41 and 42 and arms 111 and 112 of stop plate 100. As best seen in FIG. 2 tie rod 42 projects into slot 106. The rotation of plate 100 and handle 70 in a clockwise direction (in FIG. 3) is limited by arm 112 coming into abutment with tie rod 42. Rotation of plate 100 and handle 70 in a counterclockwise direction (in FIG. 3) is limited by arm 111 coming into abutment with tie rod 42.

The handle 80 is generally of the same construction as handle 70. Handle 80 includes bore 81 and shank portion 82 having a slot 86 therein. As a matter of fact handles 80 and 70 are interchangeable.

The exterior escutcheon has two openings 53 and 54 therethrough. Opening 53 is adapted to receive shank portion 82 of handle 80. Axially extending tie rods 51 and 52, which preferably are internally threaded, are provided in the inner surface of escutcheon 50 to secure escutcheon 50 to the door.

The shank portion 82 of the handle 80 extends through opening 53 into the interior or inner side of the escutcheon. A sleeve 86 (not shown) similar to sleeve 76 fits over the shank portion 82. A spring 60' similar to spring 60 is seated on the sleeve 86.

A disk shaped plate 200 is mounted on the shank 82 of handle 80. Plate 200 has a central aperture 202 (not shown) which is generally complimentary in cross-sectional shape to the shank 82, e.g., is generally circular, and fits over shank 82. Two tabs 203 and 204 extend radially inwardly into the central aperture 202. The tabs 203 and 204 fit into slot 86 in shank 82, thereby preventing the plate 200 from turning on shank 82.

The plate 200 is secured to shank 82 of handle 80 against axial movement by snap ring 120' inserted into a snap ring annular groove (not shown) in the distal end of shank 82. A washer 130' can be disposed intermediate snap ring 120' and the plate 200.

A helical torsion spring 60' similar to spring 60 having two radially outwardly projecting ends 61' and 62' is disposed over sleeve 86 intermediate plate 200 and the inner side of escutcheon 50. One of ends 61' or 62' abuts against tie rod 51 or 52 while the other end abuts against axially projecting tab 212 of plate 200.

Figure 8:
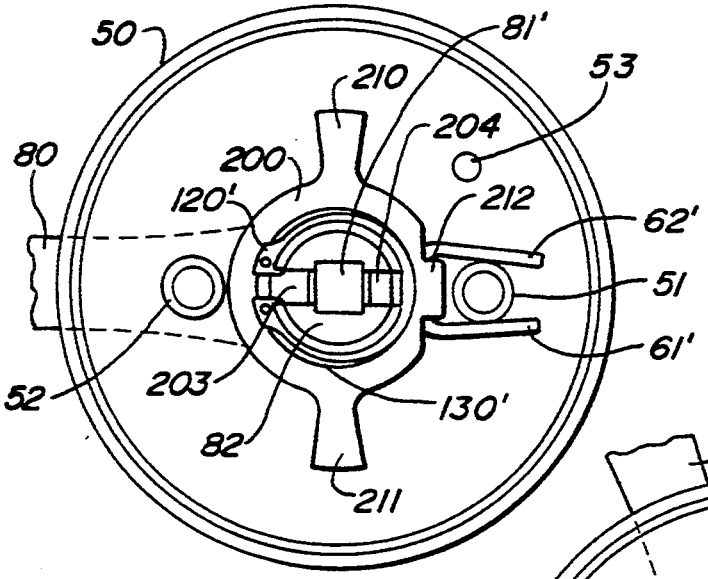
FIG. 8 is a bottom plan view of the inner side of the outside or exterior escutcheon and handle.
Figure 9:
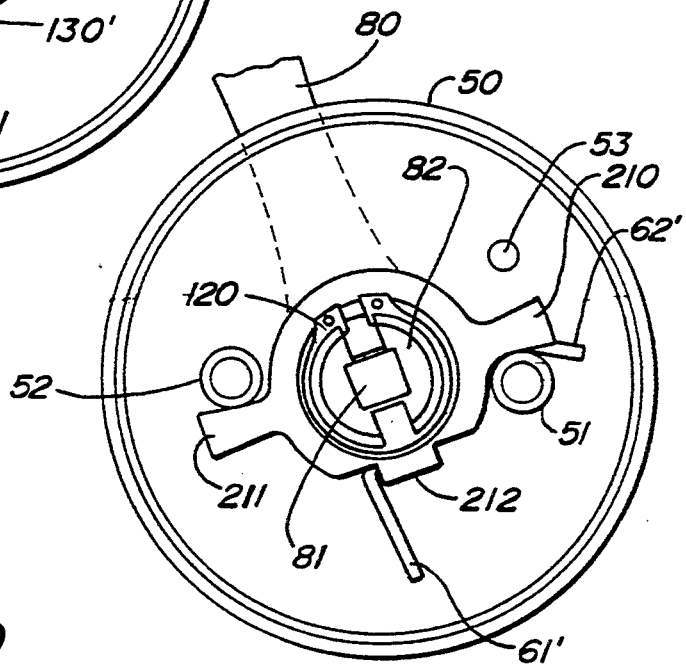
FIG. 9 is a view similar to that of FIG. 8 except with the outside handle in a different position.

In FIG. 8 the handle 80 and the plate 200 are illustrated in the neutral position. If the handle 80 is rotated clockwise (FIG. 8) the configuration illustrated in FIG. 9 is achieved. In FIG. 9 the end 62' of spring 60' abuts against tie rod 51 while end 61' abuts against tab 212. In the configuration illustrated in FIG. 9 plate 200 and handle 80 are biased by spring 60' in a counterclockwise direction towards the neutral position illustrated in FIG. 8. If the plate 200 and handle 80 are rotated counterclockwise (in FIG. 8) the end 61' abuts tie rod 51 while end 62' abuts tab 212. In this position the plate 200 and handle 80 are biased by spring 60' in a clockwise direction (in FIG. 8) to the neutral position illustrated in FIG. 8.

The rotational movement of plate 200 and handle 80 is limited by tie rods 51 and 52 and radially outwardly extending arms 210 and 211 of plate 200. As illustrated in FIG. 9 clockwise (in FIG. 8) rotational movement of plate 200 and handle 80 is limited by arms 210 and 211 coming into abutment with tie rods 51 and 52 respectively. Rotation of plate 200 and handle 80 counterclockwise (in FIG. 8) is likewise limited by arm 211 coming into abutment with tie rod 51 and arm 210 coming into abutment with tie rod 52. As illustrated in FIGS. 8 and 9 arms 210 and 211 are circumferentially spaced apart by about 180°.

Another feature of the latch of the instant invention is that it can be opened from outside the room in the event of an emergency. The opening 54 in escutcheon 50 is aligned with the face 94 of stop cap 93. As best seen in FIGS. 5 and 6 face 94 is conical in shape. If the stop cap 93 is engaged in lock notch 110, i.e., the latch is locked, and it is desired to open the door from outside the room, a long thin tool, such as for example, a straight portion of a wire coat hanger, can be inserted through opening 54 in escutcheon 50 to contact the conical face 94. Pushing the tool further in will push stop cap 93 out of engagement with lock notch 110, i.e., from the position illustrated in FIG. 5 to the position illustrated in FIG. 6.

The foregoing detailed description has been given for clearness of understanding only and no unnecessary limitations should be understood therefrom as some modifications will be obvious to those skilled in the art without departing from the scope and spirit of the appended claims.

What is claimed is:

1. A privacy lock for a door comprising:

a latch bolt assembly comprised of a latch bolt casing for mounting in a bore in said door, a latch bolt reciprocably mounted in said casing, a rotatable spindle extending through said casing, and latch bolt actuating means mounted in said casing engaging said spindle and said latch bolt for retracting or extending said latch bolt in said casing upon rotation of said spindle;

an inside escutcheon for mounting on the inside of said door;

an outside escutcheon for mounting on the outside of said door;

an inside handle rotatably mounted in said inside escutcheon, said inside handle being connected to said spindle whereby rotation of said inside handle rotates said spindle;

a spring loaded inside locking plate connected to said inside handle for rotation therewith in said inside escutcheon, said inside locking plate comprising a central portion connected to said inside handle and an outer portion at least radially spaced apart from said central portion by a slot, said outer portion of said locking plate having a radially extending lock notch therein;

a locking member axially movably mounted to said inside escutcheon, said locking member being movable to engage said lock notch thereby preventing rotation of said locking plate; and an outside handle rotatably mounted in said outside escutcheon, said outside handle being connected to said spindle whereby rotation of said outside handle rotates said spindle.

2. The lock of claim 1 wherein a spring loaded plate is connected to said outside handle for rotation therewith in said outside escutcheon.

3. The lock of claim 2 which further includes means for limiting rotational movement of said outside plate and said outside handle.

4. The lock of claim 1 wherein said spring of said spring loaded inside locking plate comprises a helical torsion spring having a central coil section, a first end coil extending radially outwardly from said central coil section, and a second end coil extending radially outwardly from said central coil section, said first and second end coils being angled toward each other and being circumferentially spaced apart.

5. The lock of claim 2 wherein said spring of said spring loaded outside plate comprises a helical torsion spring having a central section comprised of a plurality of helical coils, a first end section forming an integral extension of said coils extending radially outwardly from said central coil section, and a second end section forming an integral extension of said coils extending radially outwardly from said central coil section, said first and second end sections being angled toward each other and being circumferentially spaced apart.

6. The lock of claim 1 wherein said central portion and said outer portion lie in different axially spaced apart planes.

7. The lock of claim 6 wherein said slot is arcuate in shape.

8. The lock of claim 7 wherein said lock notch is disposed in the radially outer side of said slot.

9. The lock of claim 8 wherein said outer portion of said locking plate is semicircular in shape.

10. The lock of claim 1 wherein said locking member comprises a spindle extending axially through said inside escutcheon, a control knob on one end of said spindle exterior of said inside escutcheon, and a locking cap adapted to engage said lock notch on the other end of said spindle interior of said inside escutcheon.

11. The lock of claim 1 which further includes means for limiting rotational movement of said inside locking plate and said inside handle.

12. The lock of claim 1 wherein said central portion of said inside locking plate is disc shaped.

13. A door including a privacy lock comprising:

a latch bolt assembly comprised of a latch bolt casing mounted in a bore in said door, a latch bolt reciprocably mounted in said casing, a spindle rotatably extending through said casing, and latch bolt actuating means engaging said spindle and said latch bolt for retracting or extending said latch bolt in said assembly upon rotation of said spindle;

an inside escutcheon disposed on the inside of said door;

an outside escutcheon disposed on the outside of said door;

an inside handle extending through said inside escutcheon and rotatable therein, said inside handle being attached to said spindle so that rotation of said handle rotates said spindle;

an inside locking plate engaged with said inside handle for rotation therewith disposed interiorly of said inside escutcheon, said inside locking plate comprising a central portion engaging said inside handle and an outer portion axially spaced apart from said central portion by a slot, said outer portion of said locking plate having locking means therein;

an axially movable locking member cooperating with said inside escutcheon, said locking member being movable to engage said locking means thereby preventing rotation of said locking plate; and an outside handle extending through said outside escutcheon, said outside handle engaging said spindle whereby rotation of said outside handle rotates said spindle.

14. The door of claim 13 wherein a spring cooperates with the locking plate and the inside escutcheon to bias said plate to a neutral position.

15. The door of claim 14 wherein said spring comprises a torsion spring comprised of a plurality of helical coils forming a central section having a top and a bottom, a first end member forming an integral extension of said coils extending radially outwardly from the bottom of said central section and a second end member forming an integral extension of said coils extending radially outwardly from the top of said central section.

16. The door of claim 14 wherein a spring loaded plate is connected to said outside handle for rotation therewith in said outside escutcheon.

17. The door of claim 14 wherein said central portion of said inside locking plate is disc shaped.

18. The door of claim 17 wherein said central portion and said outer portion lie in different axially spaced apart planes.

19. The door of claim 18 wherein said slot is arcuate in shape.

20. The door of claim 17 wherein said outer portion of said locking plate is arc shaped.

21. The door of claim 14 wherein said locking means comprise a radially extending lock notch in said outer portion of said locking plate.

22. The door of claim 21 wherein said lock notch is disposed in the radially outer side of said slot.

23. The door of claim 14 wherein said locking member comprises a spindle extending axially through said inside escutcheon, a control knob on one end of said spindle exterior of said inside escutcheon, and a locking cap adapted to engage said lock notch on the other end of said spindle interior of said inside escutcheon.

24. The door of claim 14 which further includes means for limiting rotational movement of said inside locking plate and said inside handle.

25. The door of claim 14 wherein said spring comprises a helical torsion spring having a central coil section, a first end coil extending radially outwardly from said central coil section, and a second end coil extending radially outwardly from said central coil section, said first and second end coils being angled toward each other and being circumferentially spaced apart.

* * * * *